United States Patent [19]

Lindsay

[11] Patent Number: 4,915,876

[45] Date of Patent: Apr. 10, 1990

[54] PROCESS FOR THE DEODORIZATION AND STABILIZATION OF POLYUNSATURATED OILS

[75] Inventor: Robert C. Lindsay, Madison, Wis.

[73] Assignee: General Mills, Inc., Minneapolis, Minn.

[21] Appl. No.: 75,505

[22] Filed: Jul. 20, 1987

[51] Int. Cl.[4] ..... C11B 5/00

[52] U.S. Cl. ..... 260/398.5

[58] Field of Search ..... 260/398.5

[56] References Cited

U.S. PATENT DOCUMENTS

| | | | |
|---|---|---|---|
| 3,562,301 | 2/1971 | Fryer et al. | 260/398.5 |
| 4,261,912 | 4/1981 | Tracy | 260/410.5 |
| 4,623,489 | 11/1986 | Rivers | 260/424 |

OTHER PUBLICATIONS 3-cis-Hexenal, the "Green" Reversion Flavor of Soybean Oil, by G. Hoffmann, The Journal of the American Oil Chemists' Society, vol. 38, pp. 1-3, 3/60.

A Systematic Characterization of the Reversion Floavor of Soybean Oil, by Smouse et al., The Journal of the American Oil Chemists' Society, 8/67, pp. 509-514.

*Primary Examiner*—Anton H. Sutto

*Attorney, Agent, or Firm*—Dorsey & Whitney

[57] ABSTRACT

Disclosed are novel deodorization processes to realize highly polyunsaturated oils of enhanced stability. The novel deodorization has particular suitability for processing fish oils and soybean oil. The process involves use of mild solutions of acids and/or bases in sequential distillations to manipulate the volatility of undesirable aroma compounds to effect removal of offending compounds and precursors therefor. The oils are then polished to remove residual moisture and salts and to acidify the oil.

29 Claims, 1 Drawing Sheet

PROCESS FOR THE DEODORIZATION AND STABILIZATION OF POLYUNSATURATED OILS

BACKGROUND OF THE INVENTION

1. The Technical Field

The present invention relates to food products and to processes for their preparation. In particular, the present invention provides deodorization processes for oils, especially fish oils, and the resulting deordized oils.

2. Background Art

A great deal of attention has been recently paid to the various health benefits apparently associated with consumption of fish rich in fish oil. Health benefits appear to be related to the presence of high levels of the n-3 family of polyunsaturated fatty acids. Oils containing such materials, such as fish oils, are referred to as "omega-3" oils and desirably contain high levels of n-3 fatty acids, especially eicosapentaeonoic acid ("EPA") and docosahexaenoic acid ("DHA"). Such fatty acids are called "omega-3" since the first double bond occurs in the third carbon bond counting from the end or omega position of the fatty acid.

Notwithstanding the present interest in the health benefits of fish oil consumption, nonhydrogenated fish oil generally to date has not been widely used per se or as an ingredient in processed food products for use by humans due to notorious and severe problems in odor, flavor, cholesterol level, and especially stability. Nonhydrogenated fish oils exhibit notorious instability due in part to the rapid rates of oxidative and hydrolytic rancidification. However, even if kept dry and in an oxygen limited environment, fish oils exhibit antioxidation at room temperatures leading to rapid quality deterioration.

Hydrogenated fish oils are much more stable due to the decrease in the degree of polyunsaturation and are widely used in Europe for margarine. Hydrogenation is also effective in reducing odor and flavor after deodorization. Hydrogenated fish oils have also been used in Scandinavian countries in other consumer products, e.g., baked cake. However, hydrogenation by decreasing polyunsaturation including the n-3 fatty acid component correspondingly decreases the health value of fish oil. Accordingly, it would be desirable to relaize a nonhydrogenated fish oil or food products containing such nonhydrogenated fish oils, but nonetheless of increased stability.

The principal approach taken in the art to utilize nonhydrogenated fish oil has been to employ fish oils of enhanced stability. Two broach approaches have been taken in the art to realize nonhydrogenated fish oils of enhanced stability. The first approach involves attempting to find adjuvants which can be added to finished fish oil to provide desired additional stability. For example, while the phenomenon of fish oil degradation is not completely understood, it is known, however, that oxidative rancidification is a contributing factor. Addition of known antioxidants, singly as well as commercial mixtures, some allegedly synergistic, does result in some increase in stability. However, the instability of nonhydrogenated fish oils is so great, that even addition of such materials at maximum legally permitted levels provide only modest increases in stability.

In the second approach, the art has given attention to the processing of the oil to achieve a cleaner, finished oil product. Particular attention has been given to the deodorization step in order to realize cleaner finished fish oil products. Often, the deodorization step is repeated to yield higher quality oils. Deodorization of oils by steam stripping is commonly the finishing step in edible oil processing. Indeed, deodorization is often considered a Conventional deodorization can remove undersirable flavor and odors resulting in oils which are initially clean and bland in taste and color. After conventional deodorization, however, highly polyunsaturated oils, such as soybean and fish oils, upon standing, even in anaerobic or oxygen limited environments, revert or develop flavors which resemble their initial flavor type. In Western countries, the fishy flavor developed in fish oils is found especially offensive. Also, common deodorization can lead undesirably to loss of desirable omega-3 fatty acids. Surprisingly, the present invention provides improved deodorization processes which can yield oils exhibiting not only superior initial quality, but which exhibit remarkable stability over time against oxidation.

SUMMARY OF THE INVENTION

Figure 1:
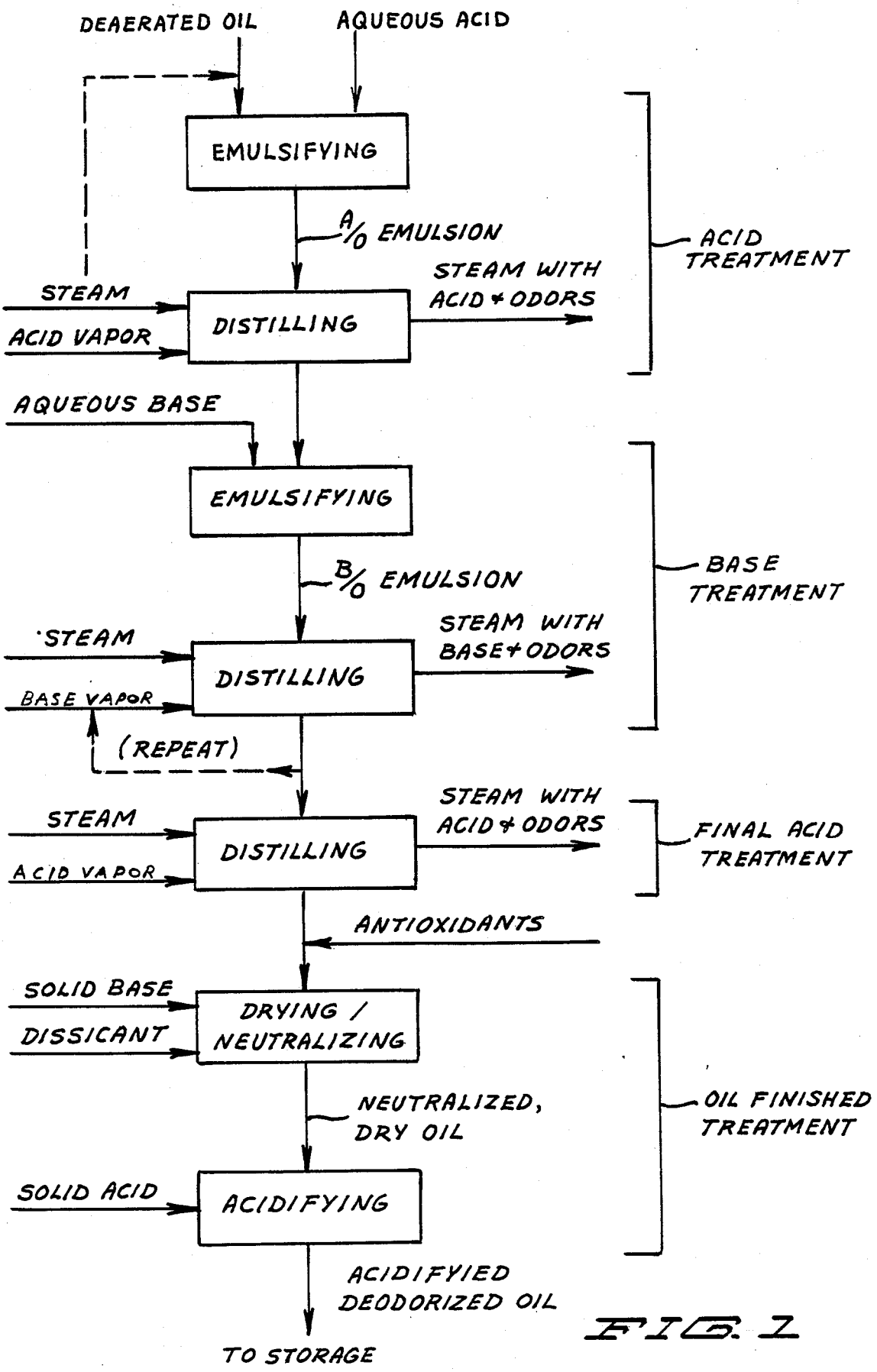
FIG. 1 is a schematic representation of the present process.

The present invention provides a superior oil deodorization method. The present methods are suitable for use with polyunsaturated oils and find particular suitability for use in connection with fish oils and soybean oil. In its product aspect, the present method provides deodorized polyunsaturated oils of enhanced stability.

In the instant process, the oil starting can be a deaerated fish or soybean oil. The daearated oil is admixed with minor amounts of acidic or basic aqueous solutions to form an emulsion and distilled with additional acid or base. Thereafter, antioxidants are added to the deodorized oil. The antioxidant loaded oil is then neutralized, dried and given a final acidification prior to storage.

DETAILED DESCRIPTION OF THE INVENTION

The present invention resides in deodorization processes for highly polyunsaturated oils, especially fish oils and soybean oils, resulting in deodorized oils of enhanced stability. The present method involves sequential formations of emulsions with defined, mild base and acid solutions followed by sequential deodorization, preferably with a specified co-distillation operation and subsequent polishing and acidification of the oil. Each of these process steps as well as process use are described in detail as follows.

Throughout the specification and claims, percentages are by weight and temperatures in degrees Fahrenheit, unless otherwise indicated.

As noted above, fish oils are particularly subject to rpaid deterioration in flavor and aroma quality after deodorization. The present invention provides processes for the realization of deodorized fish oils of superior initial quality, and, more remarkably, of enhanced extended stability. While the present invention finds particular suitability in connection with fish oils, the skilled artisan will appreciate that the present methods can also be used in connection with a wide variety of polyunsaturated oils of both vegetable and marine origin especially highly polyunsaturated oils. For example, soybean oil has a tendency to develop upon storage an undesirable beany flavor. Soybean oils can be processed according to the present methods to realize deodorized soybean oils of enhanced oil stability, i.e., which develope a reversion beany flavor much more slowly. While specific reference is made throughout to fish oil, it is to be appreciated that other oils can be similarly processed. However, minor changes in processing conditions may be necessary in order to achieve optimum results when specific other oils are being treated.

Fish oils are stables of commerce and their general processing is well known (see, for example, Fish Oils: Their Chemistry, Technology, Stability, Nutritional Propertie, and Uses, ed. by M. E. Stansby, The Avi Publishing Company, Inc. 1967 and which is incorporated by reference). Especially useful for their therapeutic value herein are oils having a total n-3 fatty acid content of greater than about 20% such as are derived from menhaden oil, herring, capelin, anchovy, cod liver, salmon oil, sardine oil and mixtures thereof. Especially preferred for use herein is menhaden oil due to such supply considerations as cost and availability as well as its nutritional quality as being high in omega-3 fats. The fish oils can be conventionally processed, e.g., extracted, refined, etc. prior to deodorization, to provide the starting fish oil. Unlike vegetable oils, however, fish oils typically do not require degumming. Also, conventional hydrogenation of the fish oil such as is done to make the oil suitable for use for the preparation of margarine is to be strickly avoided. Such starting oil is refered to as "refined oils."

Useful herein as the starting material are both freshly refined fish oil and referted fish oil. By the term "reverted fish oil" is meant fish oil which has been previously refined and conventionally deodorized but which has subsequently undergone degradation by the passage of time and/or exposure to oxygen and/or water. Such refined or reverted fish oil materials will have some level of odoriferous constituents or precursors thereto.

The starting fish oil is desirably first deaerated in conventional manner and conventional deaeration is not part of the present invention. (See for example, U.S. 3,506,696 issued Aug. 14, 1970 to Baker et al. and is incorporated herein by reference.) Deaerating the oil can be accomplished by subjecting the oil to a partial vacuum and/or by sparging an inert gas, e.g., nitrogen through the oil. For example, initially, a pressure of about 25 mm Hg is maintained for about 5 to 15 minutes. Thereafter, a modest nitrogen sparge can be continued for about 5 to 10 minutes. The particular technique or conditions employed are not critical so long as after deaeration the total dissolved oxygen is very generally less than about 0.1% by volume, preferably less than about 0.05%, prior to subsequent processing in order to prevent oxidation of the oil by dissolved oxygen.

A. Oil/Acid Emulsing Formation

In the most preferred embodiment of the present process, the first step is to form an acid-in-oil ("A/O") emulsion of the deaerated oil with a mild aqueous solution of an edible volatile acid. In more highly preferred embodiments, the acids are additionally characterized by being volatile organic acids. Useful mineral acids herein include nitric and hydrochloric acids. However, many mineral acids lack sufficient volatility and/or while potentially useful are not food approved; for example, HBr or Hr. Exemplary preferred organic acids suitable for use herein include acetic acid, and formic and mixtures thereof. While formic, propionic and/or butyric acids can be used, their use can result in the development of undesirable offflavors. Acetic acid, HCl, and mixtures thereo fare the preferred acids for use herien with acetic being most preferred. The acid solutions are mild and can range in pH from about 3 to 7, preferably 4.5 to 3 and most preferably about 3. The weight ratio of oil to acid solution can range broadly such as from about 2–8:1, preferably about 4:1.

Any common technique for formation of an emulsion can be employed consistent with the holding time of the emulsion until the to-be-described distillation step is practiced. Simple vigorous agitation can be employed. Homogenization is still another useful emulsion formation technique and provides the further advantage of realizing an emulsion which is stable for longer periods comapred to ordinary mixing. If necessary to hold the emulsions for longer times, a stable emulsion can be prepared by using an edible emulsifier.

B. Acidic Co-Distillation

If the first step of the present method is the formation of the acid-in-oil (A/O) emulsion, then thereafter, the acid-in-oil emulsion is essentially subjected to a defined co-distillation step in which volatiles are distilled off or stream stripped from the oil. The co-distillation operation can be performed from laboratory to industrial scale employing conventional apparatus. In addition to conventional steam, the present distillation step is essentially practiced with a second aqueous volatile acid in a vaporous state additionally employing the same type of volatile acids described above. However, while it is not essential that the specific types or blends of acid be employed as in the emulsion formation, it is essential that the acids added during distillation be volatile. While not essential, it is convenient, especially for laboratory scale batch operations to form an aqueous acid solution which is then heated to form an acid loaded steam used to practice the steam stripping or distillation step. Any other convenient method for continuously adding the vaporous acid solution during the distillation step can also be used such as to have a separate port or sparge for the acid addition.

The distillation step is desirably practiced at pressures ranging from bout 5 to 50 Torr., preferably 5 to 15 Torr. and temperatures ranging from 100° to 150° C., preferably 100° to 120° C. The skilled artisan will appreciate that these conditions are much milder compared to conventional deodorization practice. An important benefit resulting from the advantageously milder operating conditions is that there is less thermal cracking of the oil. Thus, the loss of desirable omega-3 fats is substantially reduced and thus preseves the nutritional advantages of the present fish oils. Further, the lower temperature suppresses undesirable polymerizations which are particularly severe problems with oils as highly polyunsaturated as fish oils.

The distillation step is practiced until a light, clean deodorized oil is obtained. The time duration of the step is not critical per se and is primarily a factor of the particular deodorizer and/or its capacity which is employed. Both continuous or batch distillation can be used.

C. Oil Base Emulsion Formation

Another step of the present method is to form a base-in-oil emulsion ("B/O") of theo il with a mildly alkaline aqueous solution of an edible volatile base, comparable generally in strength, etc. to the acid-in-oil emulsion described above. Exemplary bases include ammonium hydroxide, methyl, dimethyl or trimethyl amine and mixtures thereof. Ammonium hydroxide is the greatly preferred basic material. The pH can range from about 7 to 11, preferably about 9.5 to 11 and for best results about 11. The weight ratio of oil to base solution can range broadly such as from about 2–8:1, preferably about 4:1. The emulsion formation techniques and considerations described above for the A/O emulsion also apply to the present B/O emulsion.

Certain embodiments of the present invention comprise only treatment of the oil with acidic solutions or treatment of the oil only with basic solutions. Preferred embodiments comprise treatment of the oil with both acid and base solutions. In more preferred embodiments, the acid treatment precedes the treatment with basic solutions.

D. Basic Co-Distillation

Thereafter, the base-in-oil emulsion is essentially subjected to a defined distillation step generally comparable to the above-described acidic co-distillation step except that this distillation step is practiced with a volatile base addition in a vapor state during the step, preferably ammonium hydroxide or ammonia/water steam. Thus, the step can be described as a co-distillation or deodorization of both the underside flavor and odoriferous materials as well as the volatile base. The base distillation step is continued until a clean alkalinized light oil is produced.

The deodorized oils prepared according to the above described steps can then be treated with finishing or polishing steps.

E. Second Acidic Co-Distillation

Thereafter, the alkalinzed oil is subjected to a final acidic co-distillation step comparable in terms of conditions, acid addition, etc. to that described above to obtain an acidified, deodorized oil. By "final" is meant that an acidic co-distillation step is always the last distillation operation and will precede oil finishing operations.

F. Antioxidant Addition

It is important to add as much conventional antioxidant as is legally permissible to provide their stability benefits to the oil upon extended storage. While the oils realized by the present methods exhibit superior stability compared to conventionally processed oils, the present oils are still subject to oxidation. Conventional and suitable antioxidants include BHA, BHT, tocopherol, TBHQ and mixtures thereof. Present regulations in the U.S.A. permit addition up to about 250 ppm of antioxidants. While it is not essential to add the antioxidant prior to oil finishing, it is convenient to do so. It is essential, however, that this antioxidant addition be subsequent to all deodorization operations so as to avoid stripping of the antioxidant.

G. Removal of Residual Wet Acid

It is important in the finishing of the oils herein firstly to remove any residual moisture and/or aqueous acid from the acidified oil since even minor amounts can promote hydrolytic rancidification of the fish oil resulting in deterioration of the fish oil quality.

One convenient way to remove these residuals and simultaneously to polish the oil is to pass the deodorized acidifed oil through a first filter bed(s) comprising a solid edible alkaline material with or without a supplemental solid dissicant. The oil can be hot or cold and the finihsing operations are performed preferably under anaerobic conditions. Anaerobic conditions are especially desirable for use in connection with hot oil. As the oil passes through the bed, residual acid is neutralized to form a salt which is trapped in the bed and residual moisture is absorbed by the bed. A water absorbing material or dissicant can facilitate the moisture removal.

A suitable bed can comprise any edible, solid base, e.g., sodium bicarbonate, calcium carbonate, magnesium oxide and calcium hydroxides and mixtures thereof as an acid neutralizing agent or base. Suitable water absorbing materials can include anhydrous sodium sulfate and slica gels, and talc or diatomaceous earth for bulk, and mixtures thereof. A mixed bed can be conveniently fabricated from a mixture of base and dissicant, e.g., ranging in a weight ratio of 0.2 to 5:1. Passage through the bed results in a dried and neutralized oil.

H. Final Oil Acidulation

After neutralization and drying, it is desirable to acidify the oil. Acidification can be readily accomplished by passing the oil through a second filter bed comprising a solid, edible acidulant in a manner generally comparable to the first finishing step. Exemplary acids suitable for use herein include citric, malic, tartaric, succinic, adipic and partial salts thereof and mixtures thereof. While not wishing to be bound by the proposed theory, it is believed that an acidulated or acid stabilized oil is resistant to oxidative, fishy flavor development because 2-alkenal type compounds are effectively bound as non-odorous hydrates.

The oils from distillations using basic and acidic stripping agents, especially mineral acids and ammonium hydroxide, cause burning taste sensations. Filtration through the first bed of 1:1 mixture of sodium bicarbonate:sodium sulfate bed in the above described step removes the residual acid component while filtration through a citric acid:sodium sulfate bed removes residual volatile base and sodium bicarbonate, and adds citric acid to acidify the oil. Oils passed through these plishing beds provided extremely clean flavored oils.

Again, while not wishing to be bound by proposed theory, it is speculated herein that highly polyunsaturated fatty acids from animal sources, especially marine sources, contain unsaturated sites much closer to the carboxyl end of the chain compared to those fatty acids from plant sources, especially in the omega-3 position. Autoxidation of highly polyunsaturated fatty acids leads initially to a variety of polyfunctional acidic compounds and carbonyl compounds with varying importance in characteristic oxidized flavors, and the carbonyls continue oxidation to acids. The presence of phospholipids also provides ionizable amine groups which can readily form salts with free acids, especially shorter chain oxidation products. Additionally, 2-alkenals produced from autoxidation of polyunsaturated fatty acids readily form alpha/beta double bond hydrates and other additional compounds that are quite stable under neutral and acidic conditions. Because of the occurrence of electrically-charged flavor compounds and stable reservoirs of influential flavor compounds, previous deodorization methods for these oils have failed because equilibrium reactions that are not dependent on contact with oxygen during subsequent storage periods subsequently release offending odor and flavor compouneds. In the present invention, however, mild solutions of volatile bases and acids are used in sequential distillations to manipulate the volatility of undesirable aroma compounds or precursors therefor to effect their removal. More specifically, it is speculated that each of the acid and base stripping solutions provides extended stability to fish oils when used in succession by firstly removing alpha/beta unsaturated carbonyls by base stripping and then secondly by sweeping away remaining volatile acids and hydroxylating residual carbonyls with the acid treatment.

The clean, deodorized fish oils of the present invention exhibit very bland flavors lacking fishy or oxidized flavors and improved stability. Upon holding in modest oxidative conditions, mild green, planty flavors and aromas develop, but they lack the characteristic and distinct fishy flavor notes.

The finished oils of the present invention as described have use as a fond ingredient in a wide variety of food applications. In particular, the fish oil can be used as a nutritional supplement, e.g., in gelatin capsules or to fortify other foods such as fabricated fish or battered and breaded fish portions. The novel fish oils can also be used in full or partial substitution for conventional oils in many food products. However, while the fish oils realized herein exhibit superior stability compared to fish oils known at present, it is to be appreciated that even the improved fish oils herein do not exhibit the stability of many vegetable oils. Accordingly, food or nutritional supplement products formulated with fish oils should be handled carefully to minimize exposure to heat and oxygen.

Without further elaboration, it is believed that one skilled in the art can, using the preceding description, utilize the present invention to its fullest extent. For example, it is to be appreciated that several of the above-described steps can be repeated to realize superior quality oils. The following preferred specific embodiments are, therefore, to be construed as merely illustrative and not limitative of the remainder of the disclosure whatsoever. It will be appreciated that other modifications of the present invention, within the skill of those in the food art, can be undertaken without departing from the spirit and scope of this invention.

EXAMPLE 1

200 g of refined menhaden oil is processed on a bench scale using a bath type distillation column. The oil is emulsified with an aqueous acid solution (4:1, vol/vol; pH 4.5; 5% acedic acid in water) by homogenization. The oil/acid homogenate is steam deodorized (100°-200° C.) with aqueous acid (HCl:acetic, 1:1 vol ratio) until 1:4 vol/vol acid stripping agent is reached (approx. 30 min). This steam deodorization is then followed by another steam or basic deodorization (100°-120° C.; approx. 30 min) with aqueous ammonium hydroxide. Prior to the second deodorization, the oil is emulsified with an aqueous solution of ammonium hydroxide (pH 11, 4:1 vol/vol oil to water). The emulsion is then steam deodorized (100°-120° C.) again using the above conditions with aqueous acid (HCl:acetic in a 1:1 ratio). After final steam deodorization, a 1:1 mix of BHA/TBHQ is added as the antioxidant system to achieve 250 ppm of these antioxidants. The oils are finally polished by passing through a first filter bed comprising sodium bicarbonate and sodium sulfate (1:1 weight ratio) to remove excess HCl followed by a pass through a second filter bed comprising citric acid:-sodium sulfate bed (1:1) for final acidification of the oil.

What is claimed is:

1. A method for deodorizing a polyunsaturated oil to yield an oil of enhanced stability, comprising the steps of:

A. emulsifying a deaerated polyunsaturated oil with sufficient amounts of a first aqueous solution of a volatile mild edible base having a pH of about 7-11 to form an emulsion in a volume ratio of oil to solution ranging from about 2-8:1;

B. first basic steam co-distilling the basic emulsion at a temperature ranging from about 100° to 150° C. at a pressure of about 5 to 50 Torr with steam and a vaporous aqueous solution of an edible base whereby odoriferous constituents and substantially all of the base is removed to form an alkalinzed oil;

C. final acidic steam co-distilling the alkalinzed oil at a temperature ranging from about 100 to 150° C. at a pressure of about 5 to 50 Torr with steam and a vaporous aqueous solution of an edible volatile acid to form an acidified deodorized oil;

D. adding antioxidants to the acidified deodorized oil to form an acidified, deodorized, antioxidant-loaded oil;

E. removing residual acid and moisture from the deodorized, antioxidant loaded oil to form a dry, neutralized oil; and F. reacidulating the dry neutral oil with a solid edible acid to form a reacidulated deodorized, dry, antioxidant loaded oil of enhanced stability.

2. The method of claim 1 wherein step F is practiced by pasing the oil through a second bed comprising a solid edible acid.

3. The process of claim 2 wherein step E is practiced by passing the oil through a first bed comprising a solid mixture of edible alkali and a dissicant to remove residual acid or moisture from the oil and filter out formed salts to form the dried and neutralized oil.

4. The process of claim 3 wherien the oil is selected from the group consisting of fish oil and soybean oil.

5. The process of claim 4 wherien the oil is fish oil.

6. The process of claim 5 wherein the volatile base in steps A or B is selected from the group consisting of ammonia hydroxide, methlamine, dimethlamine, trimethlamine and mixtures thereof.

7. The process of claim 6 wherein the acid in step C is selected from the group consisting of acetic, hydrochloric and mixtures thereof.

8. The process of claim 7 wherein the pressure in steps B and C each range from about 5 to 15 Torr, and wherein the temperature in steps B and C each range from about 100° to 120° C.

9. The process of claim 8 wherein the base in steps A or B is ammonium hydroxide.

10. The process of claim 9 wherein the acid in step C is acetic acid.

11. The process of claim 10 wherien the antioxidants are selected from the group consisting of BHA, BHT, tocopherol, TBHQ and mixtures thereof.

12. The process of claim 11 wherein the first bed includes a solid alkali agent selected from the group consisting of sodium bicarbonate, calcium carbonate, magnesium oxide, calcium hydroxide and mixtures thereof and wherein the dissicant includes anhydrous sodium sulfate, silica gels, talc, diatomaceous earth and mixtures thereof.

13. The prcoess of claim 11 wherein the second bed solid edible acid is an acid selected from the group consisting of citric, malic, tartaric, succinic, adipic, partial salts thereof and mixtures thereof.

14. The process of claim 13 wherein the emulsion of step A additionally comprises an emulsifier and wherien the acid in the second bed is citric acid.

15. A method for deodorizing a polyunsaturated oil to yield an oil of enhanced stability, comprising the steps of:

A.A. emulsifying a deaerated polyunsaturated oil with sufficient amounts of a mild aqueous solution of an edible acid having a pH of about 3 to 7 to form an emulsion in a volume acid of oil to acid solution ranging from about 2–8:1;

A.B. first acidic co-distilling the acid emulsion at a temperature ranging from about 100° to 150° C. at a pressure of about 5 to 50 Torr with steam and a vaporous aqueous solution of an edible volatile acid whereby odoriferous constituents and substantially all the acid is removed to form an acidified deaerated oil;

A. emulsifying the acidifed deaerated oil with sufficient amounts of a first aqueous solution of a volatile mild edible base having a pH of about 7–11 to form an emulsion in a volume ration of oil to solution ranging from about 2–8:1;

B. first basic steam co-distilling the basic emulsion at a temperature ranging from about 100° to 150° C. at a pressure of about 5 to 50 Torr with steam and a vporous aqueous solution of an edible base whereby odoriferou constituents and substantially all of the base is removed to form an alkalinzed oil;

C. final acidc steam co-distilling the alkalinzed oil at a temperature ranging from about 100° to 150° C. at a pressure of about 5 to 50 Torr with steam and a vaporous aqueous solution of an edible volatile acid to form an acidified deodorized oil;

D. adding antioxidants to the acidified deodorized oil to form an acidified, deodorized, antioxidant loaded oil;

E. removing residual acid and moisture from the deodorized, antioxidant loaded oil to form a dry, neutralized oil; and F. reacidulating the dry neutral oil with a solid edible acid to form a reacidulated dordorized, dry, antioxidant loaded oil of enhanced stability.

16. The method of claim 15, wherein step F is practiced by passing the oil through a second bed comprising a solid edible acid.

17. The process of claim 16 wherein step E is practiced by passing the oil through a first bed comprising a solid mixture of edible alkali and a dissicant to remove residual acid or moisture from the oil and filter out formed salts to form the dried and neutralized oil.

18. The process of claim 17 wherein the oil is selected from the group consisting of fish oil and soybean oil.

19. The process of claim 18 wherein the oil is fish oil.

20. The process of claim 19 wherein the volatile base in steps A or B is selected from the group consisting of ammonium hydroxide, methylamine, dimethlamine, trimethylamine and mixtures thereof.

21. The process of claim 20 wherein the acid in step C is selected from the group consisting of acidic, hydrochloric and mixtures thereof.

22. The process of claim 21 wherein the pressure in steps B and C each range from about 5 to 15 Torr, and wherein the temperature in steps B and C each range from about 100° to 120° C.

23. The process of claim 22 wherein the base in steps A or B is ammonium hydroxide.

24. The process of claim 23 wherein the acid in step C is acetic acid.

25. The process of claim 24 wherein the antioxidants are selected from the group consisting of BHA, BHT, tocopherol, TBHQ and mixtures thereof.

26. The process of claim 25 wherein the first bed includes a solid alkali agent selected from the group consisting of sodium bicarbonate, calcium carbonate, magnesium oxide, calcium hydroxide and mixtures thereof and wherein the dissicant includes anhydrous sodium sulfate, silica gels, talc, diatomaceous earth and mixtures thereof.

27. The process of claim 26 wherein the seconed bed solid edi ble acid is an acid selected from the group consisting of citric, malic, tartaric, succinic, adipic, partial salts thereof and mixtures thereof.

28. The process of claim 27 wherein the emulsion of step A a dditionally comprises an emulsifier and wherein the acid in the second bed is citric acid.

29. The oil prepared according to the process of claim 1.

* * * * *

UNITED STATES PATENT AND TRADEMARK OFFICE

CERTIFICATE OF CORRECTION

PATENT NO. : 4,915,876

DATED : April 10, 1990

INVENTOR(S) : Robert C. Lindsay

It is certified that error appears in the above-identified patent and that said Letters Patent is hereby corrected as shown below:

In column 1, line 11, delete "deordized" and insert --deodorized--.

In column 1, line 19, delete "eicosapentaeonoic" and insert --eicosapentaenoic--.

In column 1, line 31, delete "to the rapid" and insert --to the reactivity of their unsaturated bonds. Fish oils exhibit rapid--

In column 1, line 51, delete "broach" and insert --broad--.

In column 2, line 5, delete "considered a" and insert --considered a fully developed art--.

In column 2, line 8, delete "color" and insert --odor--.

In column 2, line 46, delete "oils" and insert --oil--.

In column 2, line 58, delete "rpaid" and insert --rapid--.

In column 3, lines 3 and 4, delete "develope" and insert --develop--
In column 3, line 32, delete "referted" and insert --reverted--.

In column 3, line 56, delete "Emulsing" and insert --Emulsion--.

In column 3, line 66, delete "Hr" and insert --HF--.

In column 4, line 2, delete "offflavors" and insert --off-flavors--.

UNITED STATES PATENT AND TRADEMARK OFFICE

CERTIFICATE OF CORRECTION

PATENT NO. : 4,915,876

DATED : April 10, 1990

INVENTOR(S) : Robert C. Lindsay

It is certified that error appears in the above-identified patent and that said Letters Patent is hereby corrected as shown below:

In column 4, line 3, delete "thereo fare" and insert --thereof are--.

In column 4, line 4, delete "herien" and insert --herein--.

In column 4, line 16, delete "comapred" and insert --compared--.

In column 4, line 25, delete "stream" and insert --steam--.

In column 4, line 44, delete "bout" and insert --about--.

In column 4, line 66, delete "theo il" and insert --the oil--.

In column 5, line 27, delete "underside" and insert --undesirable--.

In column 6, line 2, delete "finihsing" and insert --finishing--.

In column 6, line 14, delete "slica" and insert --silica--.

In column 6, line 42, delete "plshing" and insert --polishing--.

In column 6, line 68, delete "compouneds" and insert --compounds--.

In column 7, line 18, delete "fond" and insert--food--.

In column 8, line 41, delete "Wherien" and insert --Wherein--.

UNITED STATES PATENT AND TRADEMARK OFFICE

CERTIFICATE OF CORRECTION

PATENT NO. : 4,915,876

DATED : April 10, 1990

INVENTOR(S) : Robert C. Lindsay

It is certified that error appears in the above-identified patent and that said Letters Patent is hereby corrected as shown below:

In column 8, line 44, delete "ammonia" and insert --ammonium-.

In column 8, line 44, delete "methlamine" and insert --methylamine--.

In column 8, line 44, delete "dimethlamine" and insert --dimethylamine--
.

In column 8, lines 44-45, delete "trimethlamine" and insert --trimethylamine--.

In column 8, line 58, delete "wherien" and insert --wherein--.

In column 9, line 7, delete "wherien" and insert --wherein--.

In column 9, line 14, delete "acid" and insert --ratio--.

In column 9, line 32, delete "vporous" and insert --vaporous--.

In column 9, line 33, delete "odoriferou" and insert --odoriferous--

In column 9, line 35, delete "acidc" and insert --acidic--.

In column 10, line 14, delete "dimethlamine" and insert --dimethylamine--.

UNITED STATES PATENT AND TRADEMARK OFFICE

CERTIFICATE OF CORRECTION

PATENT NO. : 4,915,876

DATED : April 10, 1990

INVENTOR(S) : Robert C. Lindsay

It is certified that error appears in the above-identified patent and that said Letters Patent is hereby corrected as shown below:

In column 10, line 40, delete "edi ble" and insert --edible--.

In column 10, line 44, delete "a dditionally" and insert --additionally--.

In column 10, line 46, delete "oil prepared" and insert --oil product prepared--.

Signed and Sealed this

Twenty-fifth Day of June, 1991

*Attest:*

*Attesting Officer*

HARRY F. MANBECK, JR.

*Commissioner of Patents and Trademarks*